US006095250A

United States Patent [19]

Day et al.

[11] Patent Number: 6,095,250

[45] Date of Patent: Aug. 1, 2000

[54] SUBSURFACE SAFETY VALVE ASSEMBLY FOR REMEDIAL DEPLOYMENT IN A HYDROCARBON PRODUCTION WELL

[75] Inventors: Jeffrey D. Day, Cashion, Okla.; H. Lee Nirider, Houston, Tex.

[73] Assignee: Marathon Oil Company, Findlay, Ohio

[21] Appl. No.: 09/123,227

[22] Filed: Jul. 27, 1998

[51] Int. Cl.[7] ..... E21B 34/00; E21B 34/10

[52] U.S. Cl. ..... 166/321; 166/332.8; 166/375

[58] Field of Search ..... 166/363, 332.4, 166/332.5, 332.6, 386, 373, 374, 375, 319, 321, 323, 325

[56] References Cited

U.S. PATENT DOCUMENTS

| | | | |
|---|---|---|---|
| 2,951,536 | 9/1960 | Garrett | 166/145 |
| 3,747,682 | 7/1973 | Taylor | 166/386 |
| 3,763,933 | 10/1973 | Mott | 166/322 |
| 4,071,088 | 1/1978 | Mott | 166/321 |
| 4,284,141 | 8/1981 | Mott | 166/375 |
| 4,469,179 | 9/1984 | Crow et al. | 166/319 |
| 4,513,944 | 4/1985 | Adams, Jr. | 251/89 |
| 4,694,903 | 9/1987 | Riggenberg | 166/250.08 |
| 4,844,166 | 7/1989 | Going, III et al. | 166/379 |
| 4,944,351 | 7/1990 | Eriksen et al. | 166/376 |
| 5,285,851 | 2/1994 | Pringle | 166/326 |
| 5,415,237 | 5/1995 | Strattan | 166/375 |
| 5,423,383 | 6/1995 | Pringle | 166/321 |
| 5,425,420 | 6/1995 | Pringle | 166/242.2 |
| 5,467,826 | 11/1995 | Miller | 166/380 |
| 5,488,992 | 2/1996 | Pringle | 166/332.5 |
| 5,494,105 | 2/1996 | Morris | 166/255.1 |
| 5,503,014 | 4/1996 | Griffith | 73/152.59 |
| 5,542,472 | 8/1996 | Pringle et al. | 166/65.1 |
| 5,687,794 | 11/1997 | Watkins et al. | 166/363 |

OTHER PUBLICATIONS

Pursell, J. C. et al., "Spoolable CT Completion Alternative to Rig Installation", Offshore Dec. 1983, pp. 32–33.

BST Lift Systems, Inc., "The Innovative Trimline™ Slim-hole Equipment Series including Spooler™ Coiled Tubing Equipment," Dec., 1995.

*Primary Examiner*—David Bagnell
*Assistant Examiner*—Jennifer R. Douhgerty
*Attorney, Agent, or Firm*—Jack E. Ebel

[57] ABSTRACT

A remedially deployable subsurface valve assembly is provided including a first tubing string, a first safety valve positioned in the first tubing string, a second tubing string, and a second safety valve positioned in the second tubing string. The first tubing string is a rigid production tubing string deployed in a hydrocarbon production wellbore extending beneath an earthen surface. The second tubing string is a flexible coiled tubing string remedially deployed in the interior of the first tubing string when the first safety valve fails. The second safety valve, which is located at the end of the second tubing string, is nested within the first safety valve to render the first safety valve inoperably fixed in the opened position. A seal, which is positioned in the annulus formed between the first and second tubing strings, defines a pressurizable segment of the annulus in pressure communication with the second safety valve. A second valve controller having a pressurizer is positioned at the earthen surface in pressure communication with the pressurizable segment of the annulus, which enables the operator to modify the pressure in the pressurizable segment, thereby transitioning the second safety valve between an opened and closed position.

17 Claims, 4 Drawing Sheets

SUBSURFACE SAFETY VALVE ASSEMBLY FOR REMEDIAL DEPLOYMENT IN A HYDROCARBON PRODUCTION WELL

TECHNICAL FIELD

The present invention relates generally to subsurface equipment for a hydrocarbon production well and, more particularly, to a remedially deployable safety valve assembly, which includes a coiled tubing string having a surface controlled subsurface safety valve attached thereto.

BACKGROUND OF THE INVENTION

Subsurface safety valves are commonly employed in oil or gas production wells to enable the operator to close off the flow of produced fluids from the well, if desired. A conventional subsurface safety valve assembly is shown in FIG. 1A and generally designated 10. The safety valve assembly 10 is positioned in a completed wellbore 12 penetrating a subterranean formation 14 from an earthen surface 16. It is understood that the earthen surface 16 may be substantially covered by water in a marine environment or the earthen surface 16 may be substantially exposed to the atmosphere in a land environment. A casing 18 extends the length of the wellbore 12, abutting the wellbore face 20, and a production tubing string 22 extends coaxially through the wellbore 12 within the casing 18. The production tubing string 22 has an outside diameter which is substantially less than the inside diameter of the casing 18, thereby defining a production tubing annulus 24 between the casing 18 and the production tubing string 22. The production tubing string 22 is substantially straight and relatively rigid, typically formed from multiple segments of straight rigid steel pipe which are joined together end to end. An upper segment 26*a* and a lower segment 26*b* of the production tubing string 22 are shown, having lower and upper threaded female connectors 28*a*, 28*b*, respectively, at their adjacent ends for joining the upper and lower segments 26*a*, 26*b* with the subsurface equipment, as shown and described below.

The safety valve assembly 10 includes a surface controlled subsurface safety valve (SCSSV) 30 and a control line 32 for operation of the SCSSV 30. The SCSSV 30 comprises a plurality of components, including a housing 34, a flapper 36, a flapper pivot hinge 38, a flapper seat 40, upper and lower threaded male connectors 44*a*, 44*b*, and an actuator 46. The SCSSV 30 is positioned in the production tubing string 22 by connecting the upper and lower male connectors 44*a*, 44*b* to the lower and upper female connectors 28*a*, 28*b*. In particular, the upper male connector 44*a* of the housing 34 is threaded into the lower female connector 28*a* of the upper tubing segment 26*a* and the lower male connector 44*b* of the housing 34 is threaded into the upper female connector 28*b* of the lower tubing segment 26*b* to form sealed joints 48*a*, 48*b*, which effectively integrate the SCSSV 30 into the production tubing string 22.

The open interior of the housing 34 defines an internal fluid passageway 50. The flapper 36, flapper pivot hinge 38, and flapper seat 40 are positioned in the internal fluid passageway 50. FIG. 1A shows the safety valve assembly 10 in the opened position, wherein the flapper 36 is maintained in a down position within the internal fluid passageway 50, substantially flush against the interior wall 52 of the housing 34 on the same side as the flapper pivot hinge 38. The internal fluid passageway 50 has an inside diameter substantially equal to the inside diameter of the production tubing string 22, such that the passageway 50 and interior of the production tubing string 22 form a single integrated continuous flowpath through the SCSSV 30 and production tubing string 22. For definitional purposes, the SCSSV 30, as described above, is deemed to be positioned in the production tubing string 22 insofar as the SCSSV 30 is integral with the production tubing string 22.

The actuator 46 is encased in the housing 34 and receives the subsurface end of the control line 32, which extends through the production tubing annulus 24 from the housing 34 to the surface 16. The surface end of the control line 32 is received by a valve controller 54 at the surface 16. The control line 32 enables communication of operating instructions from the valve controller 54 to the actuator 46 of the SCSSV 30 in a manner described in greater detail below.

Referring to FIG. 1B, the safety valve assembly 10 is shown in a closed position, wherein the flapper 36 has been pivotally rotated about the pivot hinge 38. The free end of the flapper 36, which is opposite the end of the flapper 36 connected to the pivot hinge 38, is in an up position in sealed abutment with the flapper seat 40, which is located on the opposite side of the interior wall 52 from the pivot hinge 38. The flapper 36 has a cross section substantially identical to that of the internal fluid passageway 50 to form a fluid seal across the flowpath through the SCSSV 30 and the production tubing string 22. As such, the closed position of the safety valve assembly 10 blocks fluid flow through the internal fluid passageway 50 and integral production tubing string 22.

Transitioning the safety valve assembly 10 between the opened position of FIG. 1A and the closed position of FIG. 1B is effected by an operator at the surface 16 who communicates a transition instruction to the SCSSV 30 via the control line 32, using the valve controller 54. The valve controller 54 is a conventional pressurizing means which maintains a pressurizable fluid in the control line 32 at predetermined pressure levels. The control line 32 is in pressure communication with the actuator 46, which is a conventional mechanical device, such as a spring-loaded latch, for alternately retaining or releasing the flapper 36. The actuator 46 maintains the flapper 36 in the down position (and correspondingly the safety valve assembly 10 in the opened position) in response to a first predetermined pressure level. When the operator wishes to transition the safety valve assembly 10 to the closed position, the operator instructs the valve controller 54 to change the pressure level of the pressurizable fluid in the control line 32 to a second predetermined pressure level. The second predetermined pressure level is communicated to the actuator 46, which reverses the position of the flapper 36 and correspondingly the position of the safety valve assembly 10.

A specific operational embodiment of the safety valve assembly 10 is illustrated below by example. The valve controller 54 is initially set by the operator at a first setting, which corresponds to the opened position of the safety valve assembly 10 shown in FIG. 1A. At the first setting, the valve controller 54 is programmed to pressurize a hydraulic fluid which fills the control line 32 and maintain the hydraulic fluid pressure at a level which is substantially above the hydrostatic pressure of the hydraulic fluid. The control line 32 communicates this elevated pressure level to the actuator 46, which mechanically maintains the flapper 36 in the down position in response to the elevated pressure level. The operator transitions the position of the safety valve assembly 10 by setting the valve controller 54 to a second setting, which corresponds to the closed position of the safety valve assembly 10 shown in FIG. 1B. At the second setting, the valve controller 54 is programmed to cease pressurizing the hydraulic fluid in the control line 32 and to depressurize the hydraulic fluid. As a result, the pressure level in the control line drops to the hydrostatic pressure of the hydraulic fluid. The control line 32 communicates this reduced pressure level to the actuator 46, which mechanically releases the flapper 36 in response to the reduced pressure level, enabling the flapper 36 to move to the up position.

Since the safety valve assembly 10 is integrally assembled with the production tubing string 22, the safety valve assembly 10 is typically installed simultaneous with installation of the production tubing string 22 during completion of the well. The installed safety valve assembly 10 is generally effective for its intended purpose. However, the safety valve assembly 10 can experience failure, most commonly resulting from a breach in the integrity of the control line 32, failure of the control line 32, or failure of a mechanical component of the SCSSV 30. Remediation of a failure requires killing the well, mobilizing a workover rig, pulling the production tubing string 22 and the integral safety valve assembly 10 from the wellbore 12, repairing or replacing the failed safety valve assembly 10, and returning the production tubing string 22 and operational safety valve assembly 10 to the wellbore 12. It is apparent that remediation of a failure requires the availability of a workover rig and is extremely costly and time consuming. The present invention recognizes a need for a less costly and time consuming, yet effective, means for remedying a subsurface safety valve assembly failure.

Accordingly, it is an object of the present invention to provide a subsurface safety valve assembly which is remedially deployable in a hydrocarbon production well. More particularly, it is an object of the present invention to provide a remedially deployable subsurface safety valve assembly which can be installed without replacing the failed subsurface safety valve assembly already present in the wellbore. It is another object of the present invention to provide a remedially deployable subsurface safety valve assembly which integrates the newly deployed subsurface safety valve assembly into the structure of the failed subsurface safety valve assembly retained in the wellbore. It is still another object of the present invention to provide a remedially deployable subsurface safety valve assembly which can be installed without pulling the production tubing string from the wellbore. It is yet another object of the present invention to provide a remedially deployable subsurface safety valve assembly which can be installed without killing the well during installation. It is a further object of the present invention to provide a remedially deployable subsurface safety valve assembly which can be installed without using a workover rig. These objects and others are achieved in accordance with the invention described hereafter.

SUMMARY OF THE INVENTION

The present invention is a remedially deployable subsurface valve assembly including a first tubing string, a first safety valve positioned in the first tubing string, a second tubing string, and a second safety valve positioned in the second tubing string. The first and second safety valves are flapper valves each have an opened position and a closed position. The first tubing string is a rigid production tubing string deployed in a hydrocarbon production wellbore extending beneath an earthen surface. A control line is positioned exteriorly to the first tubing string. The control line extends from the first safety valve to a first valve controller positioned at the earthen surface via the annulus between the first tubing string and the well casing. When the first safety valve is operable, the control line provides pressure communication between the first safety valve and a first valve controller for transitioning the first safety valve between the opened and closed position.

The second tubing string is a flexible coiled tubing string remedially deployed in the interior of the first tubing string when the first safety valve fails. The second safety valve located at the end of the second tubing string is nested within the first safety valve to render the first safety valve inoperably fixed in the opened position. The outside diameter of the second tubing string is substantially less than the inside diameter of the first tubing string to define an annulus between the first and second tubing strings. A seal is positioned in the annulus between the first and second tubing strings to block fluid flow through the annulus at the seal. The seal is made of a seal nipple associated with the first safety valve and a latch associated with the second safety valve which receives the seal nipple. The seal defines a pressurizable segment of the annulus above the seal which is in pressure communication with the second safety valve. A second valve controller comprising a pressurizer is positioned at the earthen surface in pressure communication with the pressurizable segment of the annulus between the first and second tubing strings. The pressurizer enables the operator to modify the pressure in the pressurizable segment, thereby transitioning the second safety valve between the opened and closed position.

The invention will be further understood from the accompanying drawings and description.

DESCRIPTION OF PREFERRED EMBODIMENTS

Figure 1B:
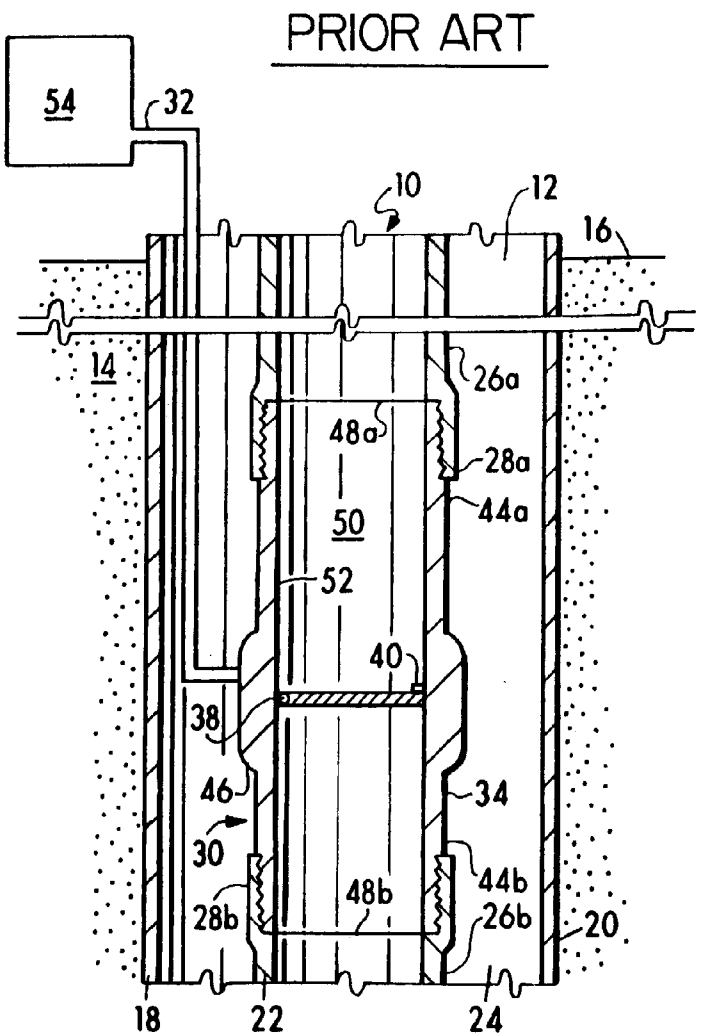
FIG. 1B is a cross-sectional conceptualized view of the safety valve assembly of FIG. 1A in a closed position.
Figure 1A:
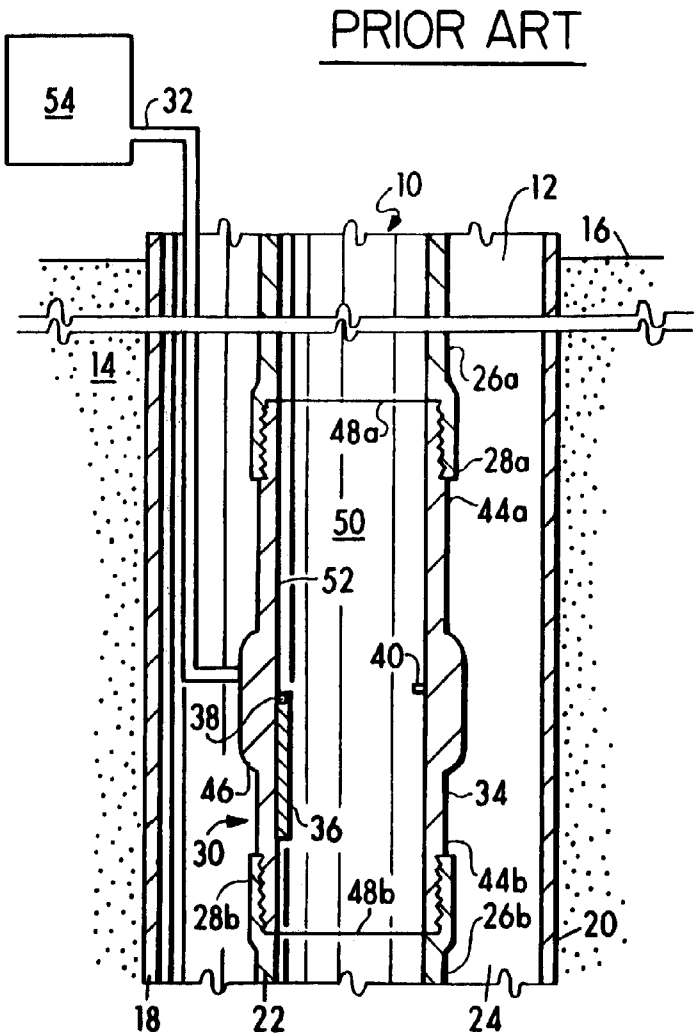
FIG. 1A is a cross-sectional conceptualized view of a conventional safety valve assembly having a single subsurface safety valve deployed in an opened position in a production tubing string.
Figure 2:
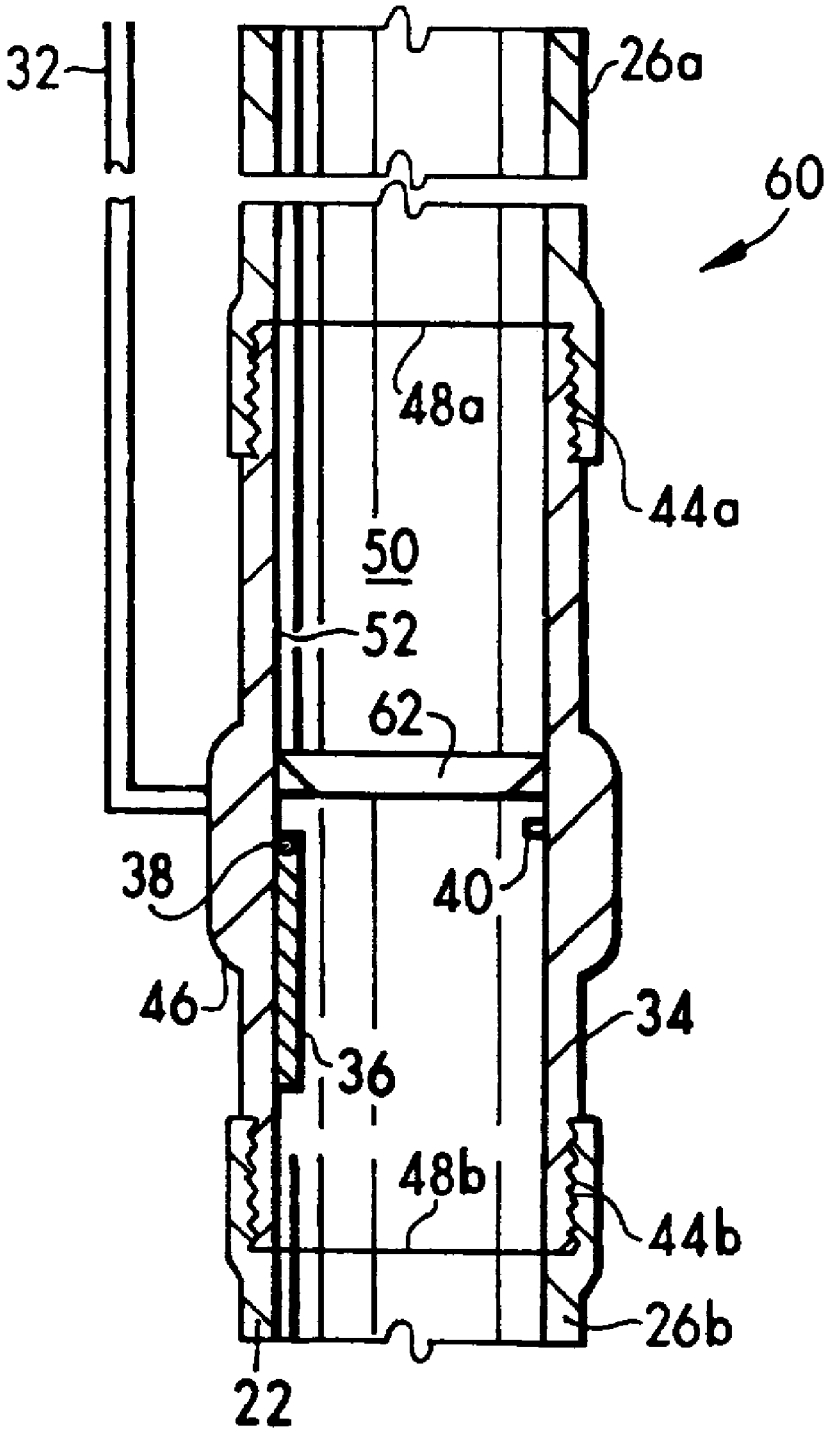
FIG. 2 is a cross-sectional conceptualized view of a subsurface safety valve in an opened position, wherein the subsurface safety valve has utility as a first subsurface safety valve in a safety valve assembly of the present invention.

The present invention is a remedially deployable subsurface safety valve assembly which is initially described with reference to FIG. 2, wherein the components of FIG. 2, which are identical to the components of FIGS. 1A or 1B, are designated by the same reference characters. An SCSSV having utility in the subsurface safety valve assembly of the present invention is shown in FIG. 2 and generally designated 60. The SCSSV 60 is substantially identical to the conventional SCSSV 30 of FIGS. 1A and 1B except that the SCSSV 60 is provided with a seal nipple 62 circumscribing the interior wall 52 immediately above the flapper pivot hinge 38 and the flapper seat 40.

Figure 3B:
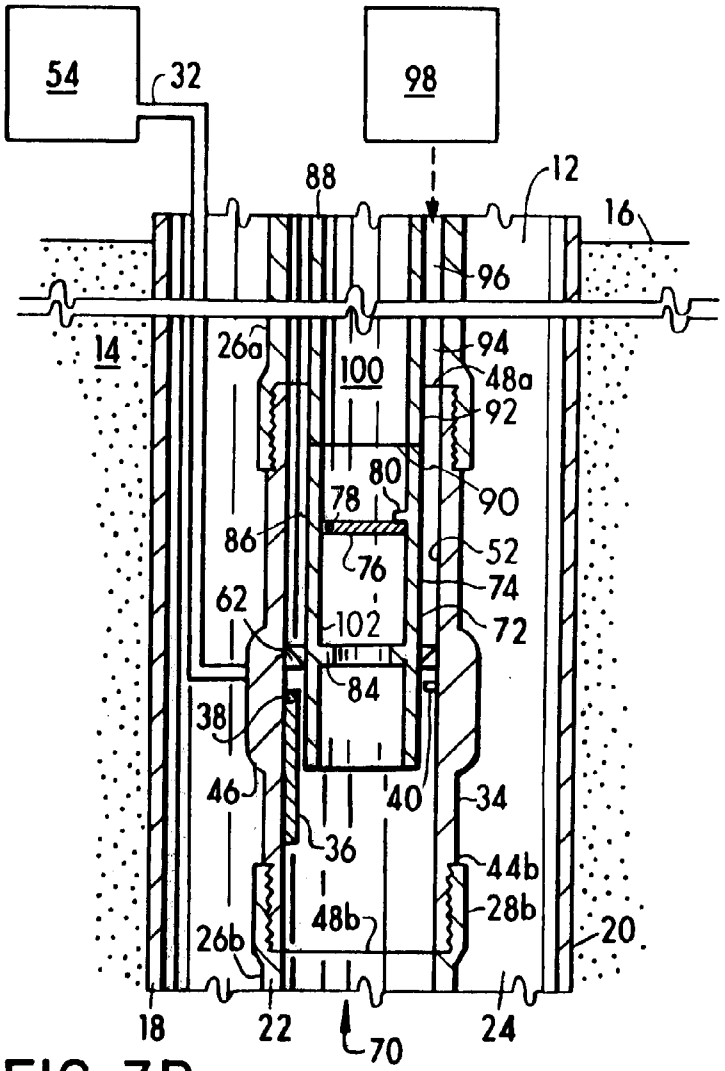
FIG. 3B is a cross-sectional conceptualized view of the safety valve assembly of FIG. 3A in a closed position.
Figure 3A:
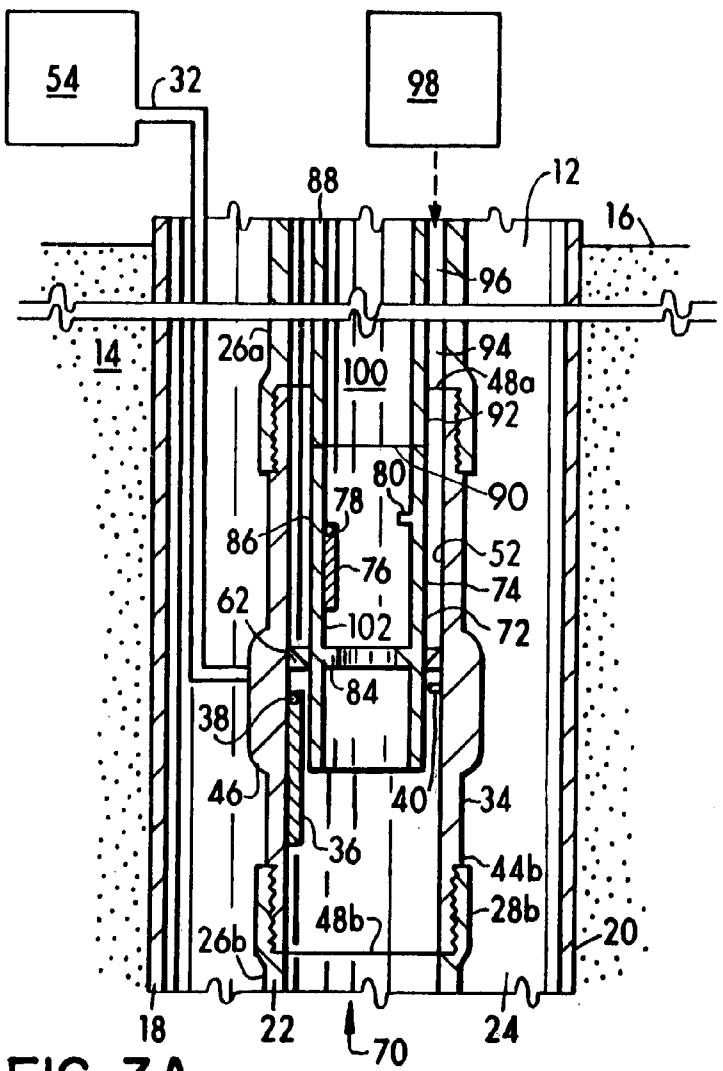
FIG. 3A is a cross-sectional conceptualized view of a safety valve assembly of the present invention including the first subsurface safety valve of FIG. 2 and further including a second subsurface safety valve deployed in an opened position in a coiled tubing string, wherein the coiled tubing string extends coaxially through the production tubing string.

Referring to FIG. 3A, the subsurface safety valve assembly of the present invention is shown and generally designated 70. Components of FIG. 3A, which are identical to the components of FIGS. 1A, 1B, or 2, are designated by the same reference characters. The safety valve assembly 70 comprises two SCSSV's including a first SCSSV 60, which is identical to that shown in FIG. 2, and a second SCSSV 72, which is coaxially nested within the first SCSSV 60. The first SCSSV 60 is alternately termed the "original" or "inoperative" SCSSV and the second SCSSV 72 is alternately termed the "remedial" or "operative" SCSSV. The second SCSSV 72 comprises a plurality of components including a housing 74, a flapper 76, a flapper pivot hinge 78, a flapper seat 80, a seal nipple latch 84 and an actuator 86. The safety valve assembly 70 further comprises the production tubing string 22 to which the first SCSSV 60 is integrally connected, the control line 32 for the first SCSSV 60 which runs through the production tubing annulus 24, and a continuous coiled tubing string 88 positioned within the production tubing string 22.

The second SCSSV 72 is mounted onto the end of the coiled tubing string 88. Attachment of the second SCSSV 72 to the coiled tubing string 88 is effected by means, such as welding or mechanical connectors, which provide the combined coiled tubing string 88 and second SCSSV 72, including the joint 90 therebetween, with a substantially smooth continuous outer surface 92. The second SCSSV 72, coiled tubing string 88 and intervening joint 90 also exhibit a substantially uniform outside diameter. This enables installation of the second SCSSV 72 within the wellbore 12 using the same conventional equipment which is used for installation of the coiled tubing string 88, as described below. The coiled tubing string 88 has a substantially smaller outside diameter than the inside diameter of the production tubing. As such, a coiled tubing annulus 94 is defined between the production tubing string 22 and the coiled tubing string 88 when the coiled tubing string 88 is coaxially positioned within the production tubing string 22.

The seal nipple latch 84 is preferably a concave structure integral with the housing 74, which does not protrude beyond the outside diameter of the second SCSSV 72 and coiled tubing string 88. When the second SCSSV 72 is properly seated within the first SCSSV 60, the seal nipple latch 84 aligns with and receives the seal nipple 62. Receipt of the seal nipple 62 releasably locks the second SCSSV 72 and coiled tubing 88 in place within the first SCSSV 60 and production tubing string 22, respectively. The seal nipple 62, in cooperation with the seal nipple latch 84, provides an effective fluid seal across the coiled tubing annulus 94. The fluid seal prevents fluid communication between an upper segment 96 of the coiled tubing annulus 94, which is located above the seal nipple 62, and the remainder of the wellbore 12. The fluid seal correspondingly enables pressurization of the upper segment 96, which is filled with a pressurizable hydraulic or pneumatic fluid and which is in communication with a second valve controller 98 at the surface 16 for the second SCSSV 72.

The second SCSSV 72 is similarly configured to the first SCSSV 60, but scaled down in size to fit within the first SCSSV 60. The interior of the housing 74 of the second SCSSV 72 defines an internal fluid passageway 100 and the flapper 76, flapper pivot hinge 78, and flapper seat 80 are positioned in the internal fluid passageway 100. FIG. 3A shows the safety valve assembly 70 in the opened position, wherein the flapper 76 is maintained in a down position in the internal fluid passageway 100 substantially flush against the side of the interior wall 102 of the housing 74 adjacent to the flapper pivot hinge 78. The internal fluid passageway 100 has an inside diameter substantially equal to that of the coiled tubing string 88, such that the passageway 100 and interior of the coiled tubing string 88 form a single integrated continuous flowpath through the second SCSSV 72 and the coiled tubing string 88. Even when the safety valve assembly 70 is in the opened position, however, the seal nipple 62 blocks upward fluid flow into the production tubing string 22, other than through the internal fluid passageway 100. For definitional purposes, the second SCSSV 72, as described above, is deemed to be positioned in the coiled tubing string 88 insofar as the second SCSSV 72 is integral with the coiled tubing string 88. It is also noted that when the second SCSSV 72 is nested in the first SCSSV 60, the flapper 36 of the first SCSSV 60 is fixedly maintained in the down position by the housing 74 of the second SCSSV 72 and rendered wholly inoperable.

Referring to FIG. 3B, the safety valve assembly 70 is shown in a closed position, wherein the flapper 76 has been pivotally rotated about the pivot hinge 78. The free end of the flapper 76, which is opposite the end connected to the pivot hinge 78, is positioned in the up position in sealed abutment with the flapper seat 80, which is located on the side of the interior wall 102 opposite the pivot hinge 78. The flapper 76 has a cross section substantially identical to that of the internal fluid passageway 100 to form a fluid seal across the flowpath through the second SCSSV 72 and the coiled tubing string 88. As such, the closed position of the safety valve assembly 70 blocks fluid flow through the internal fluid passageway 100 and integral coiled tubing string 88, as well as anywhere else through the production tubing string 22 at the point of the second SCSSV 72.

Operation of the safety valve assembly 70, transitioning between the opened position of FIG. 3A and the closed position of FIG. 3B, is effected in a manner similar to that described above with respect to the safety valve assembly 10. However, the pressurizable upper segment 96 of the coiled tubing annulus 94, rather than a dedicated control line positioned in the coiled tubing annulus 94, is used to communicate the transition instructions to the second SCSSV 72 from the second valve controller 98, which includes a conventional pressurizer. Assuming the opened position is the initial desired mode of valve assembly operation, the operator at the surface 16 initially sets the second valve controller 98 to a first setting, which corresponds to the opened position of the safety valve assembly 70 shown in FIG. 3A. At the first setting, the second valve controller 98 is programmed to pressurize the pressurizable fluid filling the upper segment 96 and maintain the fluid pressure at a first predetermined pressure level, which is elevated substantially above either the ambient atmospheric pressure or the hydrostatic pressure, depending on whether the pressurizable fluid in the upper segment 96 is a pneumatic fluid or a hydraulic fluid, respectively. The upper segment 96 communicates the first predetermined pressure level to the actuator 86 of the second SCSSV 72, which is encased in the housing 74 and is in pressure communication with the upper segment 96. The actuator 86 maintains the flapper 76 in the down position by conventional mechanical means in response to the first predetermined pressure level. The actuator 86 may also provide a counter force, which biases the flapper toward the up position, but is restrained when the safety valve assembly 70 is in the opened position.

When the closed position is the desired mode of valve assembly operation, the operator transitions the safety valve assembly 70 to the closed position by setting the second valve controller 98 to a second setting, which corresponds to the closed position of the safety valve assembly 70 shown in FIG. 3B. At the second setting, the second valve controller 98 is programmed to cease pressurizing the pressurizable fluid in the upper segment 96 of the coiled tubing annulus 94 and to depressurize the pressurizable fluid. As a result, the pressure level in the upper segment 96 drops to a second predetermined pressure level corresponding to ambient atmospheric pressure or the hydrostatic pressure of the pressurizable fluid. The upper segment 96 communicates the reduced second predetermined pressure level to the actuator 86, which mechanically releases the flapper 76 enabling the flapper 76 to move to the up position in response to the second predetermined pressure level. The above-recited procedure is reversed when it is desired to return the safety valve assembly 70 to the opened position.

The above-described operational embodiment of the safety valve assembly 70 is termed a fail safe mode of operation. It is apparent to the skilled artisan that the safety valve assembly 70 can alternatively be designed for non-fail safe operational embodiments, wherein the safety valve assembly 70 transitions to the opened position in response to a reduced pressure in the upper segment 96 of the coiled tubing annulus 94 and transitions to the closed position in response to an increased pressure in the upper segment 96. Likewise, the actuator 86 can retain the flapper 76 in the up position, while biasing it toward the down position, and drive the flapper 76 into the down position upon release.

Figure 4:
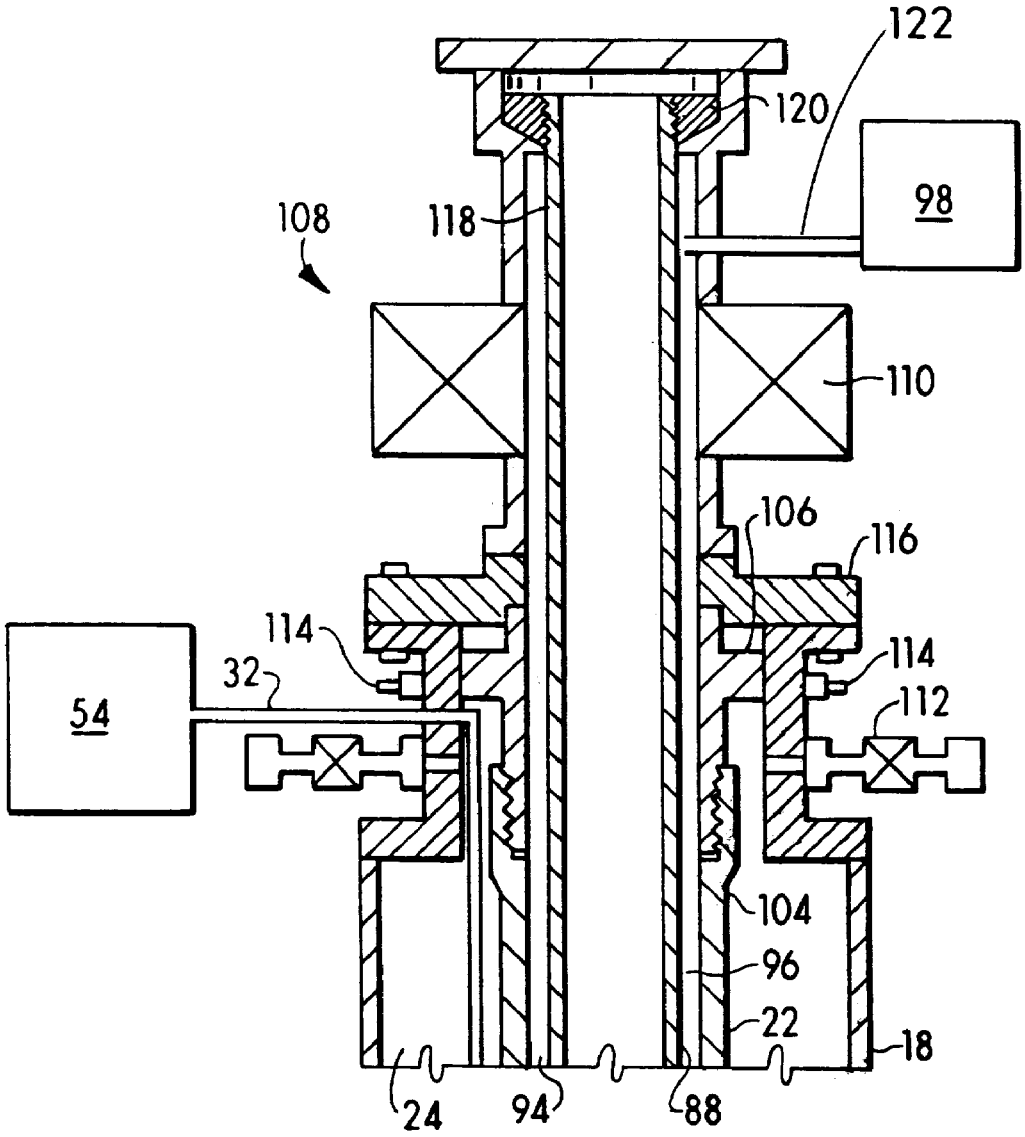
FIG. 4 is a cross-sectional conceptualized view of surface installation equipment for the safety valve assembly of the FIG. 3A.

Installation of the safety valve assembly 70 is performed in two stages, which correspond to the remedial character of the present invention. The initial installation stage is performed simultaneous with installation of the production tubing string 22 during well completion. In accordance with the initial installation stage, the first SCSSV 60 is assembled with the lower end of the production tubing string 22 at the surface 16 and the resulting integrated production tubing string 22 and first SCSSV 60 are fed into the wellbore 12 to the desired depth. The initial installation stage is concluded at the surface wellhead by supporting the upper end 104 of the production tubing string 22 with a production tubing hanger 106 which is mounted to the surface installation equipment 108 below the master valve 110, as shown in the drawings with reference to FIG. 4. Additional surface installation equipment 108 shown in FIG. 4 relating to the initial installation stage includes a casing valve 112, lock down pins 114, and a tubing bonnet 116. After well completion, hydrocarbons are produced from the formation 14 to the surface 16 via the first SCSSV 60 and production tubing string 22. If the first SCSSV 60 operates without failure for the life of the well, the second installation stage, which finalizes installation of the safety valve assembly 70, is never performed and the present invention remains practiced only in part. However, the second installation stage is performed if the first SCSSV 60 fails.

The second installation stage comprises mounting the second SCSSV 72 onto the lower end of the coiled tubing string 88 at the surface 16. Coiled tubing is a common type of tubing conventionally used in hydrocarbon production wellbore applications, wherein the coiled tubing is substantially more flexible than the relatively rigid production tubing. The coiled tubing is sufficiently flexible to enable spooling of the continuous coiled tubing string 88 onto a circular reel (not shown) for storage, transit, and handling. The second SCSSV 72 is also preferably sufficiently flexible to be bent over the radius of the coiled tubing reel without damage to the second SCSSV 72. The specific design features which provide the second SCSSV 72 with flexibility are within the purview of the skilled artisan. The coiled tubing string 88 and second SCSSV 72 are subsequently fed from the reel into the wellbore 12 from an entry point in the surface installation equipment 108 above the master valve 110. Feeding the coiled tubing string 88 and second SCSSV 72 from the reel into the wellbore 12 is accomplished using an arcuate guide arch (not shown) in a manner well known to the skilled artisan. The coiled tubing string 88 and second SCSSV 72 are fed into the wellbore 12 until the second SCSSV 72 nests in the first SCSSV 60 and latches into a releasable locked position therein.

The second and final installation stage is concluded at the wellhead by supporting the upper end 118 of the coiled tubing string 88 with a coiled tubing hanger 120 mounted to the surface installation equipment 108 above the master valve 110. It is noted that a second control line 122 is also provided with the surface installation equipment 108, which is connected to the second valve controller 98 and is in pressure communication with the upper segment 96 of the coiled tubing annulus 94. The second control line 122 enables communication between the upper segment 96 and the second valve controller 98 for operation of the safety valve assembly 70 in the manner described above. After concluding the final installation stage, normal hydrocarbon production is resumed from the formation 14 to the surface 16 via the second SCSSV 72 and the coiled tubing string 88. It is apparent that installation of the safety valve assembly 70 is accomplished without the necessity of removing or replacing the failed first SCSSV 60 or control line 32 already present in the wellbore 12. Nor is it necessary to pull the production tubing string 22 from the wellbore 12 or kill the well before installing the safety valve assembly 70. Installation of the safety valve assembly 70 can also be accomplished using conventional coiled tubing completion equipment, obviating the need for a workover rig. Accordingly, the present invention realizes considerable time and cost savings.

Failure of the safety valve assembly 70 during subsequent hydrocarbon production after installation of the assembly 70 is readily remedied in accordance with the present invention. If the second SCSSV 72 fails or the coiled tubing annulus 96 becomes plugged, the problem is remedied by unlatching the second SCSSV 72, pulling the coiled tubing string 88 and second SCSSV 72, curing the cause of inoperation, and reinstalling the coiled tubing string 88 and operable second SCSSV 72 in substantially the same manner as described above.

While the foregoing preferred embodiments of the invention have been described and shown, it is understood that alternatives and modifications, such as those suggested and others, may be made thereto and fall within the scope of the present invention. For example, the housings 34, 74 of the first and second SCSSV's 30, 72 have been described above as initially being separate structures, which are integrated into the production tubing string 22 and coiled tubing string 88 by connection thereto. It is apparent to the skilled artisan, however, that the separate housings 34, 74 can be omitted from the first and second SCSSV's 30, 72 within the scope of the present invention. The internal components of the first and second SCSSV's 30, 72 can be assembled directly into the production and coiled tubing strings 22, 88, with the segments of the tubing strings 22, 88 containing the internal components functioning as the valve housings.

We claim:

1. A remedially deployable subsurface valve assembly comprising:

a first tubing string deployed in a hydrocarbon production wellbore extending beneath an earthen surface, wherein said first tubing string defines a first tubing string exterior having an outside diameter and a first tubing string interior having an inside diameter;

a first safety valve positioned in said first tubing string, said first safety valve having a first valve member selectively displaceable between a first valve opened position and a first valve closed position;

a second tubing string deployed in said first tubing string interior, wherein said second tubing string defines a second tubing string exterior having an outside diameter and a second tubing string interior having an inside diameter, further wherein said outside diameter of said second tubing string exterior is substantially less than said inside diameter of said first tubing string interior to define an annulus between said first and second tubing strings;

a second safety valve positioned in said second tubing string and nested within said first safety valve, said second safety valve having a housing enclosing a second valve member selectively displaceable between a second valve opened position and a second valve closed position, wherein said housing is adjacent to said first valve member in said annulus between said first and second tubing strings, said housing substantially blocking selective displacement of said first valve member to said first valve closed position, thereby rendering said first valve member substantially fixed in said first valve opened position; and a seal positioned in said annulus between said first and second tubing strings to block fluid flow through said annulus at said seal, wherein said seal defines a pressurizable segment of said annulus in communication with said second safety valve for transitioning said second valve member between said second valve opened position and said second valve closed position.

2. The remedially deployable subsurface valve assembly of claim 1, wherein said first tubing string is formed from a substantially rigid tubing.

3. The remedially deployable subsurface valve assembly of claim 1, wherein said second tubing string is formed from a substantially flexible coiled tubing.

4. The remedially deployable subsurface valve assembly of claim 1 further comprising a control line positioned in said first tubing string exterior and in communication with said first safety valve for transitioning said first valve member between said first valve opened position and said first valve closed position in the absence of said second safety valve.

5. The remedially deployable subsurface valve assembly of claim 4, wherein said annulus between said first and second tubing strings is a first annulus, said remedially deployable subsurface valve assembly further comprising a casing deployed in said exterior of said first tubing string, wherein said casing has an inside diameter substantially greater than said outside diameter of said first tubing string to define a second annulus between said casing and said first tubing string, and wherein said control line is positioned in said second annulus.

6. The remedially deployable subsurface valve assembly of claim 4, wherein said control line extends from said first safety valve through said first tubing string exterior to the earthen surface.

7. The remedially deployable subsurface valve assembly of claim 1, wherein said seal comprises a seal nipple on said first safety valve and a latch in said second safety valve to receive said seal nipple.

8. The remedially deployable subsurface valve assembly of claim 1 further comprising a pressurizer in communication with said pressurizable segment of said annulus between said first and second tubing strings to modify the pressure in said pressurizable segment and transition said second valve member between said second valve opened position and said second valve closed position.

9. The remedially deployable subsurface valve assembly of claim 8, wherein said pressurizer is positioned at the earthen surface.

10. The remedially deployable subsurface valve assembly of claim 1, wherein said first safety valve is a flapper valve and said first valve member is a flapper.

11. The remedially deployable subsurface valve assembly of claim 1, wherein said second safety valve is a flapper valve and said second valve member is a flapper.

12. The remedially deployable subsurface valve assembly of claim 1, wherein said annulus is substantially open from said earthen surface to said seal.

13. A remedially deployable subsurface valve assembly comprising:

a first tubing string deployed in a hydrocarbon production wellbore extending beneath an earthen surface, wherein said first tubing string defines a first tubing string exterior having an outside diameter and a first tubing string interior having an inside diameter;

a first safety valve positioned in said first tubing string, said first safety valve having a first valve member selectively displaceable between a first valve opened position and a first valve closed position;

a second tubing string deployed in said first tubing string interior, wherein said second tubing string defines a second tubing string exterior having an outside diameter and a second tubing string interior having an inside diameter, further wherein said outside diameter of said second tubing string exterior is substantially less than said inside diameter of said first tubing string interior to define an annulus between said first and second tubing strings;

a second safety valve positioned in said second tubing string and nested within said first safety valve (to render said first safety valve substantially fixed in said first valve opened position), said second safety valve having a housing enclosing a second valve member selectively displaceable between a second valve opened position and a second valve closed position, wherein said housing is adjacent to said first valve member in said annulus between said first and second tubing strings, said housing substantially blocking selective displacement of said first valve member to said first valve closed position, thereby rendering said first valve member substantially fixed in said first valve opened position;

a seal positioned in said annulus between said first and second tubing strings to block fluid flow through said annulus at said seal, wherein said seal defines a pressurizable segment of said annulus in communication with said second safety valve for transitioning said second valve member between said second valve opened position and said second valve closed position; and a pressurizer in communication with said pressurizable segment of said annulus to modify the pressure in said pressurizable segment.

14. The remedially deployable subsurface valve assembly of claim 13, wherein said annulus is substantially open from said earthen surface to said seal.

15. A method for remedial deployment of a subsurface valve assembly in a hydrocarbon production wellbore extending beneath an earthen surface comprising:

attaching a first safety valve to a first tubing string to position said first safety valve in said first tubing string, wherein said first tubing string defines a first tubing string exterior having an outside diameter and a first tubing string interior having an inside diameter;

placing said first tubing string and said first safety valve positioned therein in said hydrocarbon production wellbore, wherein said first safety valve has a first valve member with a first valve opened position and a first valve closed position and said first safety valve is operable in said hydrocarbon production wellbore when said first valve member is transitional between said first valve opened position and said first valve closed position;

when said first safety valve is rendered inoperable in said hydrocarbon production wellbore, attaching a second safety valve to a second tubing string to position said second safety valve in said second tubing string and nest said second safety valve within said first safety valve, wherein said second tubing string has defines a second tubing string exterior having an outside diameter and a second tubing string interior having an inside diameter;

placing said second tubing string and said second safety valve positioned therein in said first tubing string interior, wherein said second safety valve has a housing enclosing a second valve member with a second valve opened position and a second valve closed position and wherein said outside diameter of said second tubing string is substantially less than said inside diameter of said first tubing string interior to define an annulus between said first and second tubing strings, further wherein said housing is adjacent to said first valve member in said annulus substantially blocking displacement of said first valve member to said first valve closed position, thereby rendering said first valve member substantially fixed in said first valve opened position;

sealing said annulus between said first and second tubing strings to block fluid flow through said annulus at said seal, wherein said seal defines a pressurizable segment of said annulus above said seal in communication with said second safety valve; and modifying the pressure in said pressurizable segment to transition said second valve member between said second valve opened position and said second valve closed position.

16. The method for remedial deployment of a subsurface valve assembly in a hydrocarbon production wellbore of claim 15 wherein said annulus is sealed by inserting a seal nipple on said first safety valve into a latch in said second safety valve.

17. The method for remedial deployment of a subsurface valve assembly in a hydrocarbon production wellbore of claim 15, wherein said annulus is substantially open from said earthen surface to said seal.

* * * * *